US005769477A

United States Patent [19]

Lehrer

[11] Patent Number: 5,769,477

[45] Date of Patent: Jun. 23, 1998

[54] COVERING/CARRIER FOR A BOOK

[76] Inventor: Nicki L. Lehrer, 13304 Ridge Dr., Rockville, Md. 20850

[21] Appl. No.: 745,176

[22] Filed: Nov. 7, 1996

[51] Int. Cl.[6] ..... B42D 3/18

[52] U.S. Cl. ..... 294/138; 281/34; 294/149

[58] Field of Search ..... 294/138, 141, 294/149, 152–157; 190/115; 206/424, 450, 472; 281/19.1, 20, 29, 31, 34, 35; 283/64

[56] References Cited

U.S. PATENT DOCUMENTS

| | | | |
|---|---|---|---|
| 473,540 | 4/1892 | Wheeler . | |
| 745,251 | 11/1903 | Sleght . | |
| 1,136,598 | 4/1915 | Gould . | |
| 1,373,136 | 3/1921 | Kranz . | |
| 1,475,586 | 11/1923 | Lalonde | 281/34 |
| 1,708,813 | 4/1929 | Ware | 281/34 |
| 2,410,741 | 11/1946 | Lesavoy . | |
| 3,297,341 | 1/1967 | Reed et al. | 281/34 |
| 4,036,417 | 7/1977 | Traphagan . | |
| 4,209,187 | 6/1980 | Forrest | 281/19.1 |
| 4,616,851 | 10/1986 | Mann | 281/34 X |
| 4,958,759 | 9/1990 | Jarvis . | |
| 5,180,191 | 1/1993 | Biba . | |
| 5,352,007 | 10/1994 | Kirsch . | |

*Primary Examiner*—Johnny D. Cherry
*Attorney, Agent, or Firm*—Nixon & Vanderhye

[57] ABSTRACT

The covering includes a rectilinear sheet of material having top, bottom and side edges and handles laterally spaced from one another along a top edge of the sheet material. A bottom panel may be folded about a first foldline to overlie the sheet material and side panels are folded about second foldlines perpendicular to the first foldline to overlie the sheet material. Each side panel with an end portion of the folded bottom panel forms a pocket for receiving a corner of a book cover. By disposing the book covers into the pockets of the side sections, the covering not only covers the book but forms a carrier with the book being supported along the bottom foldline of the pockets when held by the handles.

20 Claims, 8 Drawing Sheets

COVERING/CARRIER FOR A BOOK

TECHNICAL FIELD

The present invention relates to a covering or a carrier for a book and particularly relates to a covering or carrier formed of sheet material which may be folded about various foldlines to accommodate books of different sizes and preferably has flexible handles for carrying the book.

BACKGROUND

Many different types of coverings for books have been proposed and constructed in the past. Most are constructed of a particular size for use with a particular size of book. This, of course, requires multiple different sized coverings for differently sized books, as well as requiring an individual covering a book to know in advance what covering size is required before procuring the covering. Also, coverings for a book are generally not provided with straps or handles whereby the book can be readily carried using such handles. Where book coverings have been provided with handles, for example, see U.S. Pat. Nos. 2,410,741 and 1,136,598, the handles are fixed to the covers along their side edges and this precludes adjustment of the covering for different sized books. Also, there is the added expense of providing handles for each different size of book covering if such book covers are to be utilized. Additionally, many book covers are pre-formed. That is, they are folded into or provided in discrete multiple parts to form a predetermined configuration. Various methods are then employed to maintain that configuration, for example, the folded or discrete elements are often glued or sewn to one another. This, of course, increases manufacturing costs and the ultimate costs for the book covering which, again, is useful only for a particular size book. Thus, there has developed a need for a covering for a book which can be inexpensively formed, configured to afford a covering for books of various sizes, i.e., heights and lengths as well as thicknesses, and which covering provides handles whereby the book can be readily and easily carried.

DISCLOSURE OF THE INVENTION

In accordance with the present invention, there is provided a novel and improved covering for a book which may be formed from a single sheet of flexible material and folded in such manner that the front and back covers of a book can be inserted into pockets formed by the folded sheet material. Handles are preferably applied to or formed integrally with the sheet material before folding and may be used to carry and support the book within the covering. To accomplish the foregoing, the sheet material in its generic form may be provided in a generally rectilinear planar configuration having top, bottom and side edges, with a pair of handles being secured or integrally formed with the sheet material along a top portion of the rectilinear sheet. The handles are preferably formed of a flexible material which may be identical to or different than the flexible material of the covering itself. The flexible handles, attached to the sheet material or integral therewith, project beyond the top edge of the rectilinear sheet.

In a preferred embodiment, a bottom panel of the sheet material is folded about a first foldline generally parallel to the bottom edge to overlie a portion of the sheet material along a face of the material, the bottom panel extending between the opposite side edges of the sheet. Side panels along opposite sides and extending between the top and bottom edges of the sheet and including end portions of the folded bottom panel are preferably folded about foldlines generally perpendicular to the first-mentioned foldline. It will be appreciated that by folding the side panels such that lower portions thereof overlie the face of the sheet material, pockets are formed by the side panels and folded end portions of the bottom panel at opposite lower corners of the covering. Those corners are utilized to receive the bottom corners of the front and back covers of the book. With the handles projecting from the top of the sheet material and the bottom panel folded along the bottom of the material, it will be further appreciated that the foldlines along the end portions of the bottom panel form bottom supports in the pockets for the corners of the front and back covers whereby the bottom foldlines of the end bottom panel portions support the book within the covering when carried by the handles.

In addition, pockets may be formed for receiving the upper corners of the front and back covers of the book. To accomplish this, projecting tabs are provided on the sheet material in its planar form along the side margins of the sheet material. By folding over the tabs onto the face of the sheet material prior to folding the side panels, it will be appreciated that, when the side panels are folded with the tab, the tab and portion of the side panel form a pocket for receiving the upper corners of the front and back covers. While the folded tab does not provide a book supporting function when the book is carried by the handles, it does retain the covering against the cover of the book and provides a finished appearance to the covering.

The sheet material may be provided in a single size which can be folded by the user to accommodate and provide a covering for books of various sizes. Thus, the bottom panel may be folded about the first foldline at various distances from the bottom edge of the sheet material to accommodate books of different heights. Likewise, the side panels may be folded about the second foldlines at various distances from the side edges of the sheet material to accommodate books of different widths, that is, books having different distances between the side edges of the front and back covers when the book is opened and the covers lie in a common plane. Various indicia may optionally be provided on the face of the sheet to indicate the location of the foldlines for various sizes of books.

It will be appreciated also that the handles may be formed integrally with the sheet material of the covering or may be secured separately to the covering. For example, plastic handles may be secured by adhesive to sheet material formed of paper. Further, the bottom panel may be reinforced by a discrete piece of material suitably secured to the sheet material by glue or the like.

In a preferred embodiment according to the present invention, there is provided a covering for a book having front and back covers comprising a sheet of flexible material having top, bottom and opposite side edges and first and second opposite faces, a bottom panel of the sheet material being folded about a first foldline generally parallel to the bottom edge to overlie a portion of the sheet material along the first face thereof, the folded bottom panel extending between the opposite side edges, a pair of side panels extending between the top and bottom edges, and including end portions of the folded bottom panel, folded about second foldlines generally parallel to the side edges and perpendicular to the first foldline to overlie portions of the sheet material along the first face thereof and portions of the bottom panel folded about the first foldline, bottom portions of the folded side panels and the folded bottom end portions thereof forming pockets for receiving respective corners of the front and back covers of a book, a pair of handles secured to the sheet material along a top portion thereof and between the side edges, the handles projecting from the top portion for carrying a book overlying the sheet material with corners of the front and back covers of the book received in the pockets, respectively.

In a further preferred embodiment according to the present invention, there is provided a covering for a book having front and back covers comprising a first sheet of flexible material having top, bottom and opposite side edges and first and second opposite faces, a second sheet of flexible material overlying a bottom portion of the first sheet material along the first face thereof, the second sheet extending between the opposite side edges of the first sheet and forming with the bottom portion of the first sheet a multi-ply layer along the bottom of the covering, a panel of the multi-ply layer being folded about a first foldline generally parallel to the bottom edge to overlie a portion of the multi-ply layer, the folded multi-ply panel extending between opposite side edges, a pair of side panels extending between the top and bottom edges, including end portions of the multi-ply panel folded about respective foldlines generally parallel to the side edges and perpendicular to the bottom edge to overlie portions of the sheet material along the first face thereof and portions of the multi-ply panel, bottom portions of the folded side panels and the bottom end portions of the multi-ply panel forming pockets for receiving respective corners of the front and back covers of a book, a pair of handles secured to the sheet material along a top portion thereof and between the side edges, the handles projecting from the top portion for carrying a book overlying the sheet material with bottom corners of the front and back covers of the book received in the pockets, respectively, formed along bottom portions of the covering.

In a still further preferred embodiment according to the present invention, there is provided a covering for a book having front and back covers comprising a sheet of flexible material having top, bottom and opposite side edges and first and second opposite faces, a bottom panel of the sheet material being folded about a first foldline generally parallel to the bottom edge to overlie a portion of the sheet material along the first face thereof, the folded bottom panel extending between the opposite side edges, a pair of side panels extending between the top and bottom edges, and including end portions of the folded bottom panel, folded about second foldlines generally parallel to the side edges and perpendicular to the first foldline to overlie portions of the bottom panel folded about the first foldline, the folded side panels and the folded bottom end portions of the bottom panel forming pockets for receiving respective front and back covers of a book, a pair of laterally spaced handles secured to the sheet material between the side edges and along a top portion of the covering opposite the first foldline, the handles projecting from the top portion of the covering for carrying a book overlying the sheet material with bottom corners of the front and back covers of the book received in the pockets, respectively, along a bottom portion of the covering.

Accordingly, it is a primary object of the present invention to provide a novel and improved covering for books which can be manufactured inexpensively, applied to books of various sizes and affords carrying handles for the book.

BEST MODE FOR CARRYING OUT THE INVENTION

Figure 1:
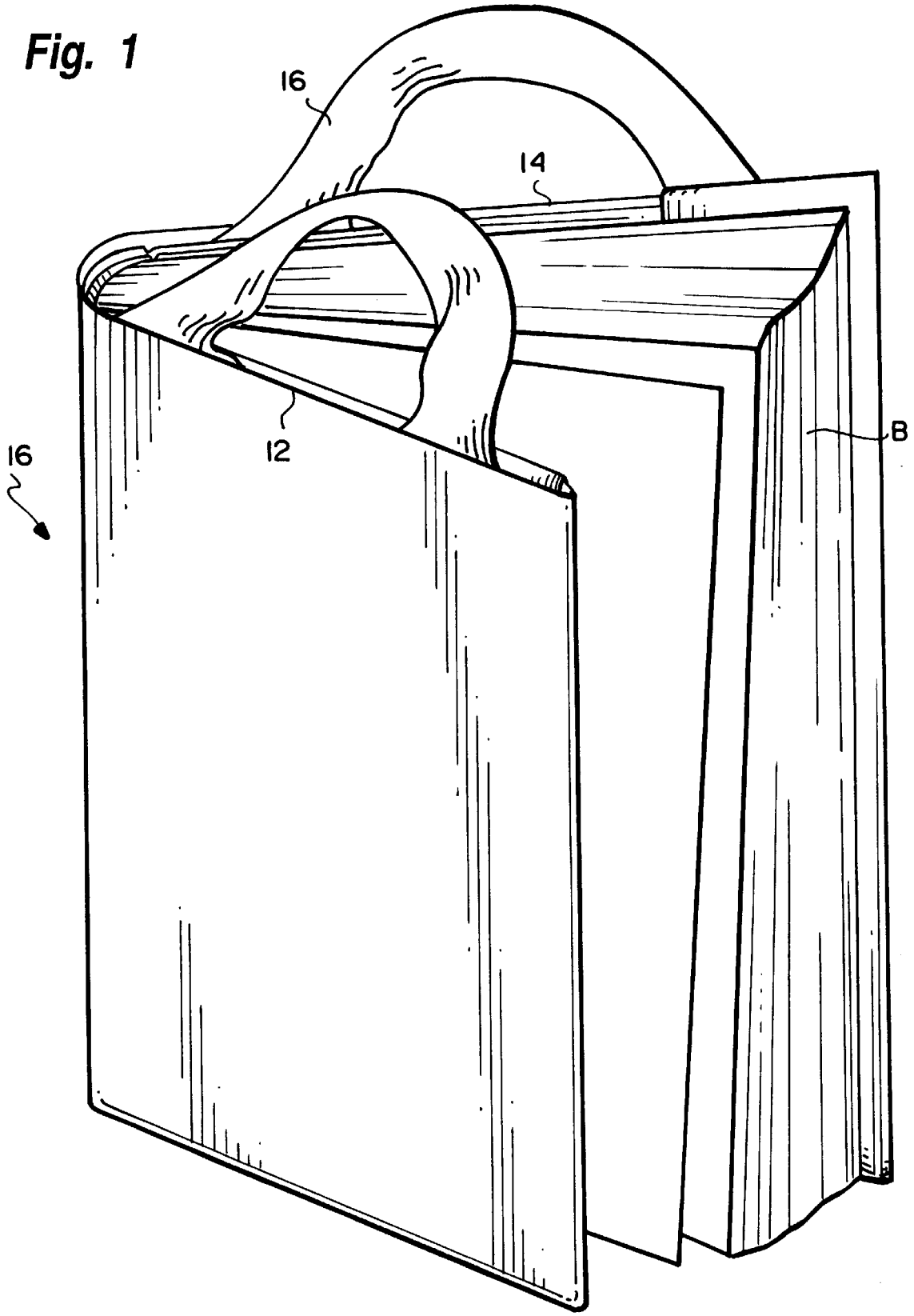
FIG. 1 is a perspective view of a covering for a book constructed in accordance with the present invention and illustrating the covering applied to a particular book.

Referring now to the drawings, particularly to FIG. 1, there is illustrated a covering, generally designated 10, for a book B, the front and back covers 12 and 14, respectively, of the book being illustrated in pockets of the covering, described below, the covering having handles 16. It will be noted that the handles lie along the top or bottom of the covering adjacent the top or bottom pages of the book and not along the free side edges of the book, the book being supported in the covering otherwise than by the spine of the book.

Figure 2:
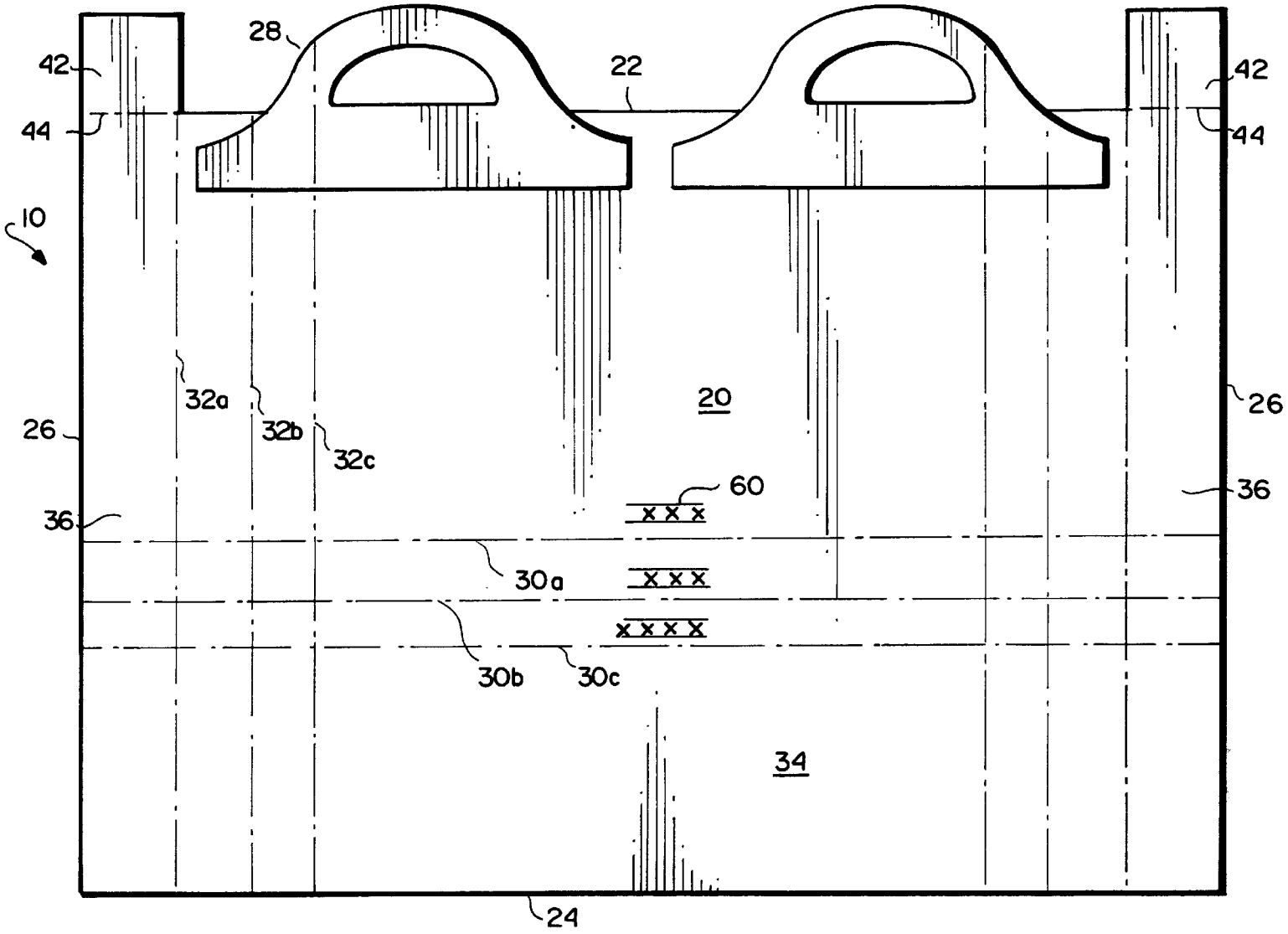
FIG. 2 is a plan view of sheet of material from which the covering of FIG. 1 is formed.

Referring now to FIG. 2, there is illustrated the covering 10 in laid-out or plan form prior to configuring it to a particular book. The covering 10 is formed of flexible sheet material 20. The material may comprise any flexible sheet material such as paper, plastic, fabric, vinyl, leather and the like. As illustrated, sheet 20 has top, bottom and side edges 22, 24 and 26, respectively. Handles 28 are provided along the top portion of the sheet 20. The handles may be formed of a similar material as the sheet 20 or a dissimilar material and may be variously secured to the sheet 20 or form an integral part of the sheet 20. For example, as illustrated in FIG. 2, sheet 20 may be formed of paper and the flexible handles 28 formed of a plastic material adhesively secured to the upper margins of the sheet 20. It will be appreciated that the handles may be formed of various types of materials such as paper, vinyl, fabric, cardboard, rubber, twisted paper, plastic, leather, burlap and the like. While the handles are preferably formed of a flexible material so that in use they can lie along the upper margins of the book when the book is not in use, it will be appreciated that solid materials may also be used, such as wood, wire or even ceramic materials whereby the handles may project from the upper margins of the book. Handles slidable relative to the sheet 20 may also be used. For example, twisted paper or braided fabric may be provided with end enlargements serving as stops preventing the handles from sliding further along apertures provided in the sheet material. Also, the handles may be secured to the sheet material by discrete elements, such as a separate piece of flexible material secured to the sheet material. For example, where the covering is formed of paper, a separate piece of paper may be adhesively secured along the inside or outside face of the sheet material with positions of the handle therebetween. Alternatively, a top portion of the sheet material may be folded down, secured intermediate its ends to the sheet material and the handles, e.g., braided paper, may extend through slots formed along the foldline.

As illustrated in FIG. 2, a pair of handles are provided in side-by-side relation one to the other, with the handles straddling a midline or median of sheet 20 between its opposite sides, and which median normally will lie along the spine of the book when the covering is applied thereto. The handles 16 are illustrated of a size for grasping by an individual's hand. It will be appreciated that the handles may be elongated, for example, to form shoulder straps.

The dot-dash lines, for example, the lines 30*a,* 30*b* and 30*c* or the lines 32*a,* 32*b* and 32*c,* represent various foldlines about which the sheet material 20 can be folded and in a certain sequence, described below, in order to provide a single sheet 20 configured as a covering and carrier for use with various sizes of books. Additional indicia may be provided, or none at all.

Figure 3:
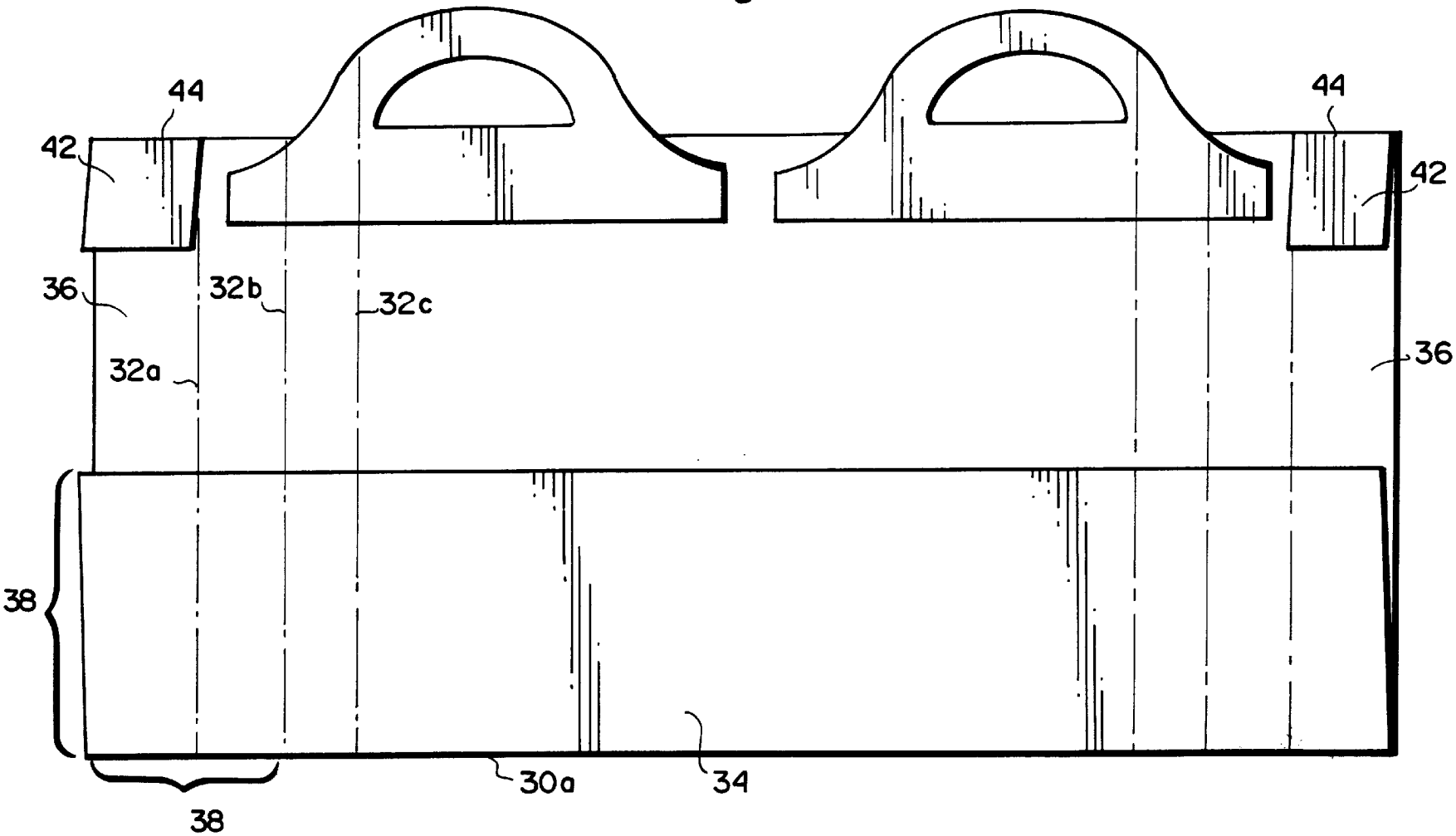
FIGS. 3 and 4 are views similar to FIG. 2 illustrating a progression of steps for forming the book covering from the sheet material of FIG. 2.
Figure 4:
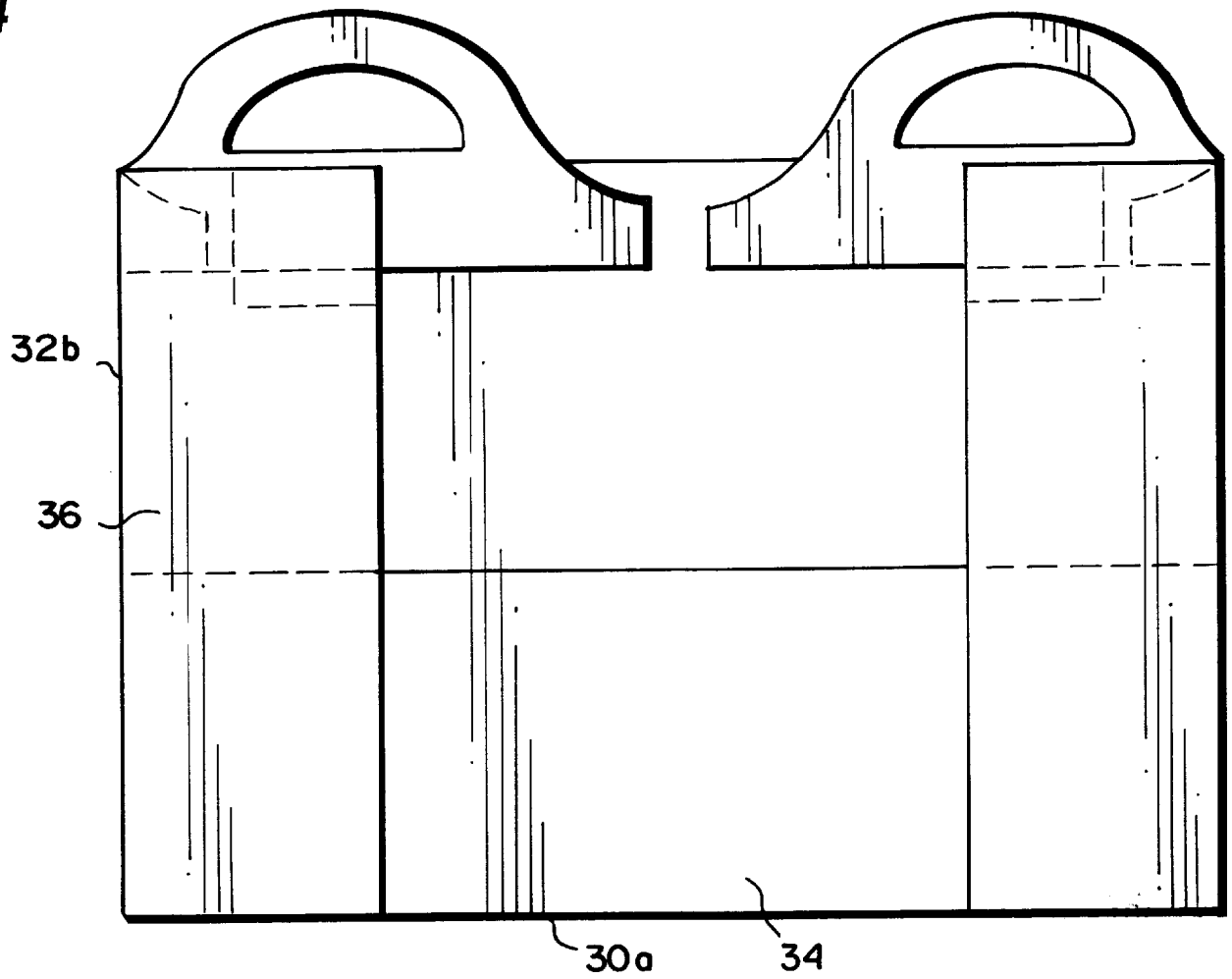
Figure 5:
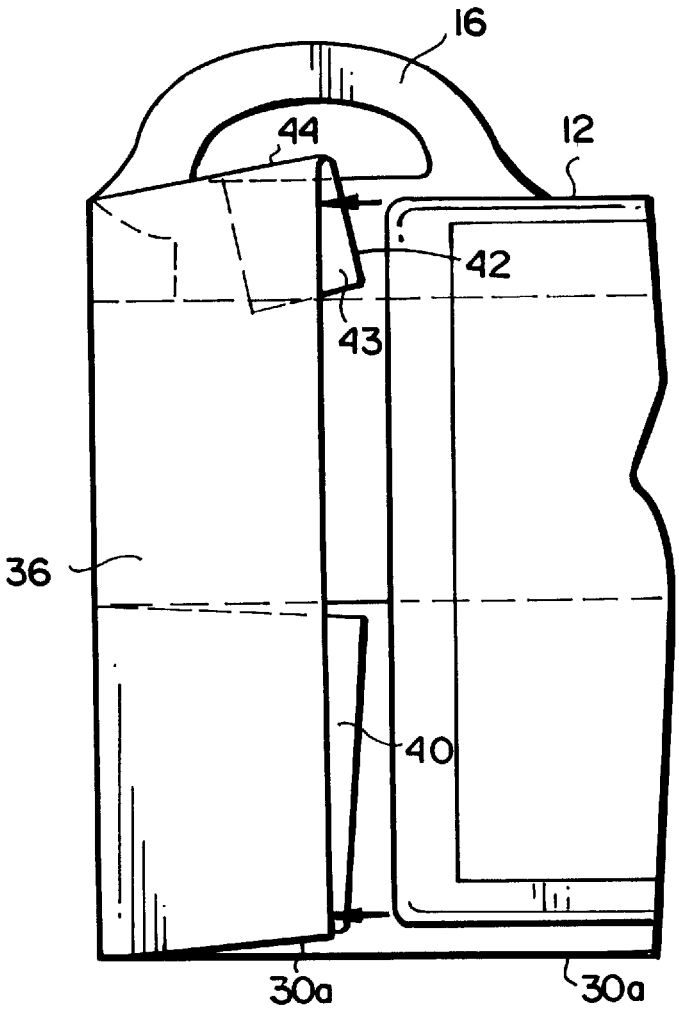
FIG. 5 is a fragmentary perspective view of a front or back cover of a book being disposed in pockets formed by the covering.

When the user desires to form a covering for a particular book from sheet 20 illustrated in FIG. 2, a bottom panel 34 is folded about the first foldline, e.g., foldline 30*a* (FIG. 2) to overlie a first or inside face of the sheet 20. The bottom panel extends between the opposite side edges 26 of sheet 20. Once this is accomplished, side panels 36 may be folded about second foldlines, e.g., foldline 32*b,* extending generally perpendicular to the first foldline 30*a,* and to the top and bottom edges of sheet 20 to overlie the inside face of sheet 20. The side panel 36, when folded, e.g., about the second foldline 32*b* as illustrated in FIG. 4, also includes an end portion 38 (FIG. 3) of the bottom panel 34. With the side panels 36 folded about second foldlines 32*b* as illustrated in FIG. 5, it will be appreciated that pockets 40 are formed adjacent the sides of sheet 20 by the respective side panels 36 and the folded-over end portions 38 of bottom panel 34. With the side panels 36 folded about second foldlines 32 at opposite sides of the covering, in this basic form of the invention, the lower corners of the front and back covers 12 and 14, respectively, of a book may be received in the respective pockets 40 as illustrated in FIG. 5. With the front and back covers received in the pockets, it will be further appreciated that the foldline 30*a* at the bottom of each pocket forms a support for the covers 12 and 14 of the book and, hence, the book when the book is carried by handles 16.

Referring back to FIGS. 2 and 3, and in a preferred form hereof, the top edge 22 of sheet 20 has projecting tabs 42. Tabs 42 are useful in forming pockets 43 along the upper side of the covering. These pockets 43 are non-supporting. The tabs 42, as illustrated in FIGS. 2 and 3, may be folded about foldlines 44 to overlie the inside face of the sheet 20, forming the pocket 43 between the tab 42 and the side panel into which may be received the upper corners of the front and back covers 12 and 14, respectively, as illustrated in FIG. 5. Tabs 42 and pockets 43, however, retain the top portions of the covering in contact with the book covers and are also useful to form a finished appearance for the covering.

In the form of the invention illustrated in FIGS. 2 through 5, portions of the handles 16 are folded with the side panels. However, the handles need not extend laterally to that extent and, therefore, need not form a portion of the side panels folded over about the second foldlines. In a preferred embodiment, the sheet material 20 may have a length of 24 inches and a height of 18 inches. Thus, by folding the various panels hereof about selected foldlines, a covering of this size can accommodate most of the variously sized books.

Figure 6:
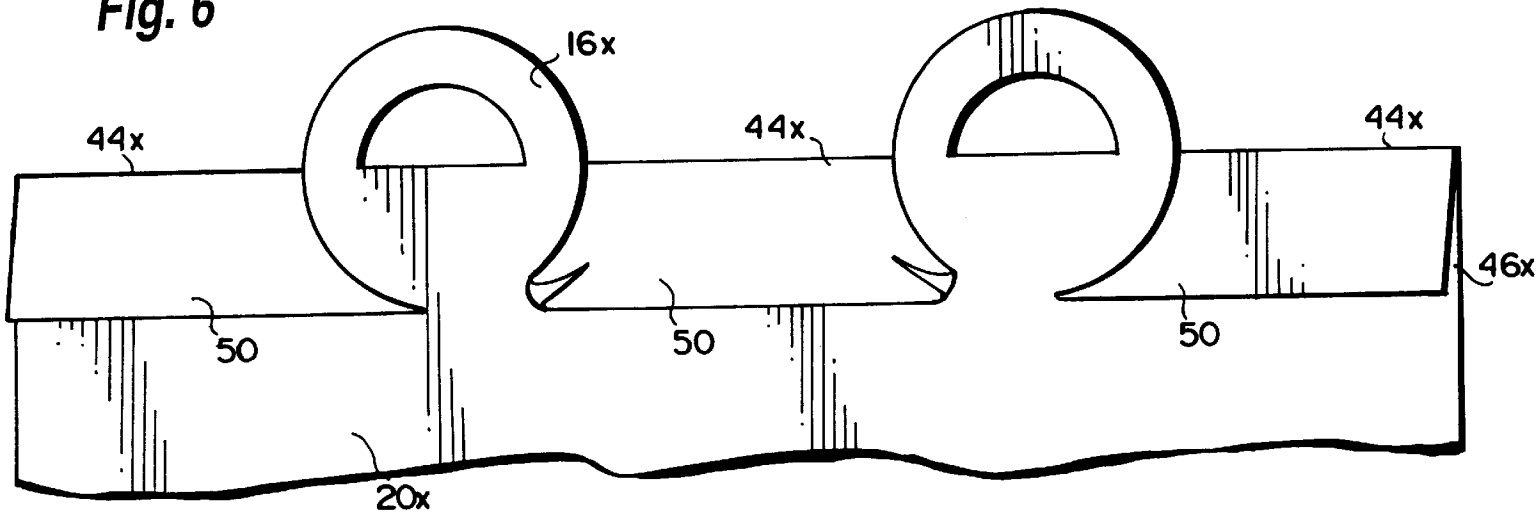
FIGS. 6, 7 and 8 are fragmentary views illustrating top portions of the sheet material in different embodiments for locating and/or forming the handles for the covering hereof.

Referring now to FIG. 6, which illustrates a further embodiment of the present invention wherein like reference numerals denote like parts, followed by the suffix x, there is illustrated a sheet 20*x* wherein the handles 16*x* are formed integrally with the sheet 20*x* by die-cutting the upper portion of sheet 20*x*. By die-cutting is meant both forming a slit through the sheet material or perforations along the material. The upper portions 50 of the sheet 20 which are die-cut are illustrated as folded down about fold axes 44*x,* thus enabling the handles 16*x* to project above the upper edge of the covering in its final configuration. The upper panels 50 may remain loose but preferably the middle panel is secured to the underlying portions of the sheet 20*x,* for example, by adhesive, whereby the covering in the region adjacent the handles is reinforced. The end panels 50*x* along their end edges remain unsecured while remaining portions of the end panels may be secured to the underlying portions of sheet 20*x*. In that connection, where the covering may be "permanently employed" with a particular book, intermediate portions of the bottom panel 34 may likewise be adhesively or otherwise secured to the inside face of sheet 20 between side panels 36 after panel 34 is folded about foldline 30*a*. Referring back to FIG. 6, it will be seen that the top end panels 50 form an upper pocket 46*x* for receiving the upper corners of the front and back covers of the book when they are folded about the second foldlines with the side panels to complete formation of the covering 10.

Figure 7:
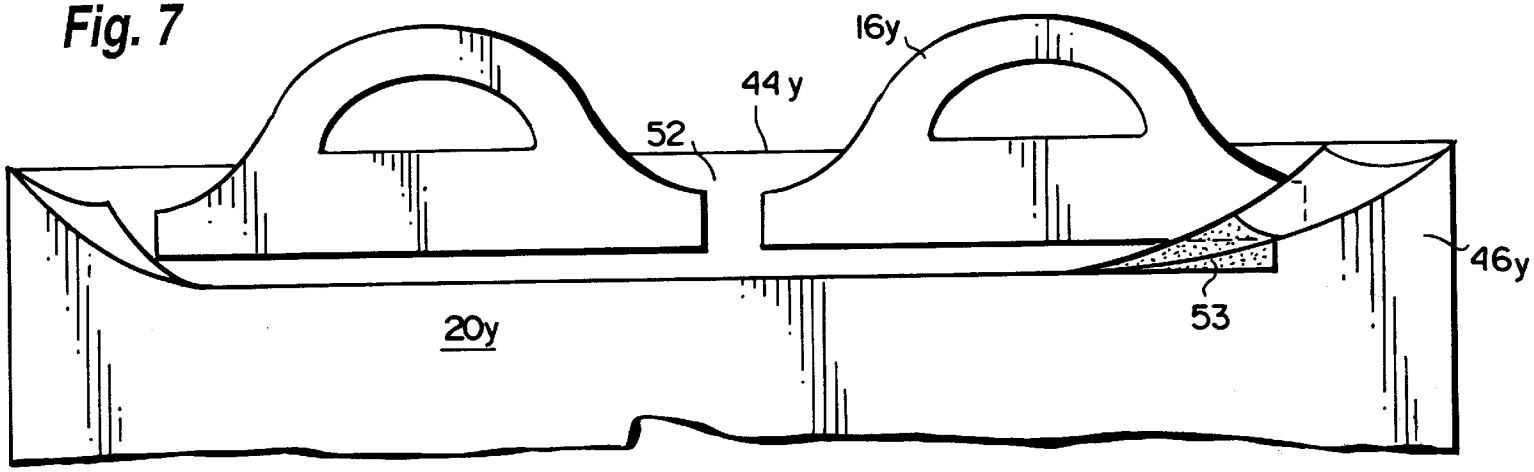

Referring to FIG. 7, a folded-over upper portion of the sheet material may be used to provide the upper pockets as well as to reinforce the upper portion of the covering adjacent the handles. Particularly, an upper portion of the covering adjacent the handles may be reinforced by folding over a top panel 52 about a further foldline 44*y,* the panel 52 extending between the opposite side edges of sheet 20. Interior portions of the folded-over panel 52 may be adhesively secured by adhesive 53 to the underlying sheet 20*y,* leaving opposite side margins of panel 52 open to form pockets 46*y* along opposite upper side edges of the covering. The handles 16*y* are secured, for example, by adhesive to the folded-over panel 52, as illustrated, i.e., upside-down along the outer face of sheet material 20*x* prior to folding. In this manner, securement between the handles and the sheet 20*y* for supporting the book is substantially reinforced. Also, while the handles are illustrated as being secured on the second face of the sheet material, the handles may be received in slots in or adjacent the foldline for securement to either the first or second faces or both.

Figure 8:
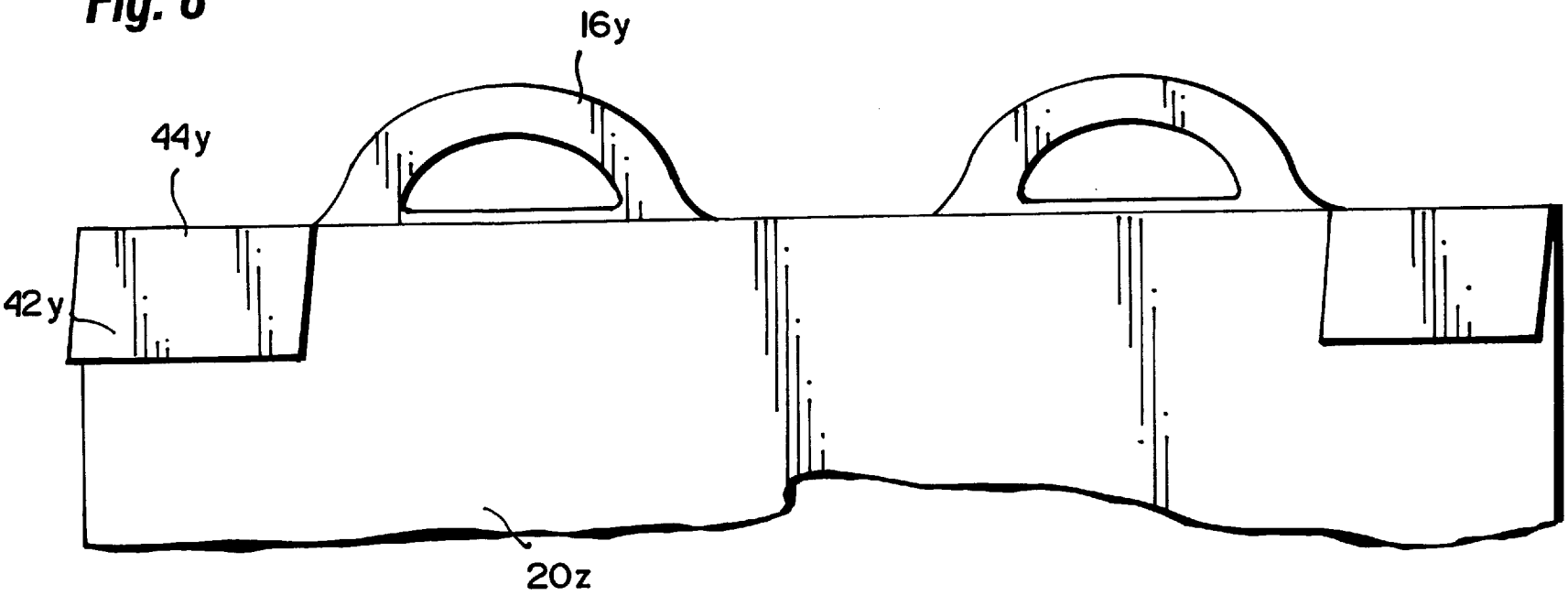

Referring now to FIG. 8, the sheet 20*z* may have tabs 42*z* folded about foldlines 44*z* similarly as in FIG. 3, the tabs being greater or lesser in lateral extent than illustrated in FIG. 3. The handles 16*z* may be secured to the sheet 20*z* along the opposite face of the sheet 20*z,* i.e., on the outside face of the covering, rather than on the inside face as illustrated in FIG. 3.

Figure 9:
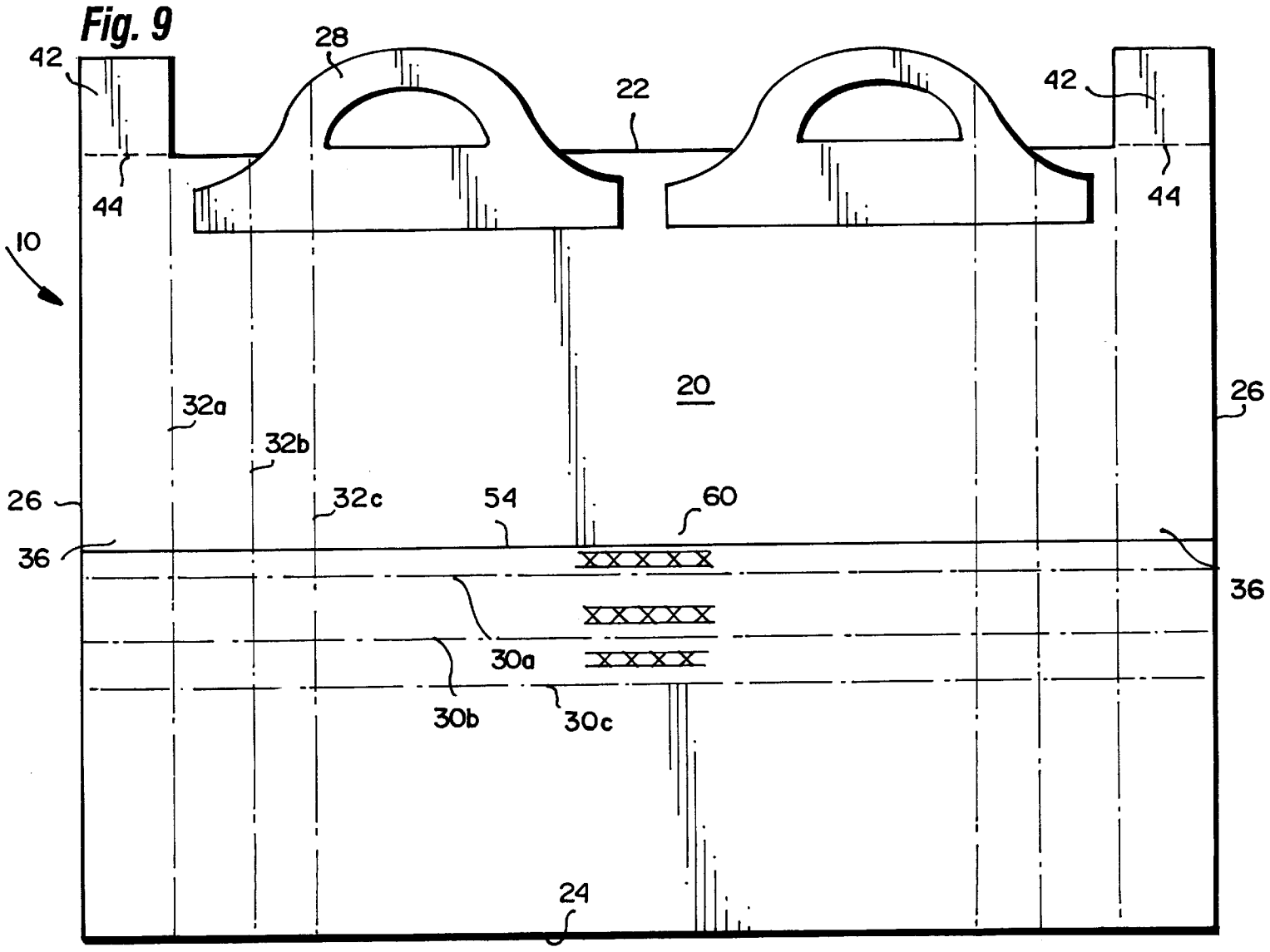
FIG. 9 is a view similar to FIG. 2 illustrating a reinforced bottom panel for the covering hereof.

In FIG. 9, there is illustrated a discrete piece of flexible material 54 which overlies a bottom portion of the sheet material 20. For example, where material 20 is formed of paper, an additional piece 54 of paper may be secured by adhesive to the inside or outside face (the inside face being illustrated) of sheet 20. Additionally, flexible material 54 thus forms with sheet material 20 a multi-ply layer which is folded as in the previous embodiments thereof about the first foldline. The first foldline, e.g., 30*a,* 30*b* or 30*c,* is therefore reinforced along its opposite end portions at locations where the weight of the book is concentrated when the covering is used as a carrier for the book. The indicia 60 can therefore be located along the reinforcing piece 54 as illustrated.

It will also be appreciated that a reinforcing strip, similar to piece 54, may be secured, e.g., by adhesive to the top portion of the sheet material 20, particularly to reinforce the handles. Thus, a sheet may be secured along the inside or outside face of the sheet material with portions of the handles therebetween ensuring a strong connection between the handles and cover.

It will thus be appreciated that by the foregoing construction, the objects of the present invention are fully accomplished. The covering 10 may be configured to fit all sizes of books by folding bottom and side panels about various ones of the fold axes 30 and 32, respectively. Indicia, including the foldlines themselves, as well as dimensional indicia 60 (FIG. 2) may be provided adjacent each of the foldlines to indicate to the user the particular foldline about which the covering may be folded to fit a particular sized book. Note also that the book will advantageously remain in a closed position when the carrying handles are grasped by the user. Also, when using flexible handles, one or both of the handles may be folded into the book and serve as a bookmark.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A covering for a book having front and back covers comprising:

a sheet of flexible material having top, bottom and opposite side edges and first and second opposite faces;

a bottom panel of said sheet material being folded about a first foldline generally parallel to said bottom edge to overlie a portion of said sheet material along said first face thereof, said folded bottom panel extending between said opposite side edges;

a pair of side panels extending between said top and bottom edges, and including end portions of said folded bottom panel, folded about second foldlines generally parallel to said side edges and perpendicular to said first foldline to overlie portions of said sheet material along said first face thereof and portions of said bottom panel folded about said first foldline;

bottom portions of said folded side panels and the folded bottom end portions thereof forming pockets for receiving respective corners of the front and back covers of a book;

a pair of handles secured to said sheet material along a top portion thereof and between said side edges, said handles projecting from said top portion for carrying a book overlying said sheet material with corners of the front and back covers of the book received in said pockets, respectively.

2. A covering according to claim 1 including tabs formed along said top portion of the sheet material adjacent opposite side edges thereof, respectively, and forming part of said side panels, said tabs being folded about third foldlines generally parallel to said first foldline to overlie a portion of the sheet material along said first face thereof and being folded with said side panels about said second foldlines to overlie portions of said sheet material along said first face thereof, said folded tabs and upper portions of said side panels forming second pockets for receiving other corners, respectively, of the front and back covers of the book.

3. A covering according to claim 1 wherein said handles are adhesively attached to said sheet material.

4. A covering according to claim 1 including indicia on said sheet material indicative of a plurality of locations of said first foldline along said sheet material in accordance with the height of a book being covered by the covering enabling books having front and back covers of different heights to be covered by said covering.

5. A covering according to claim 1 including indicia on said sheet material indicative of a plurality of locations of said second foldlines along said sheet material in accordance with the width of a book being covered by the covering enabling books of different widths to be covered by said covering.

6. A covering according to claim 1 wherein said top portion of said sheet material is die cut to form said handles.

7. A covering according to claim 1 wherein a section of said top portion is folded about a fourth foldline to overlie said first face of said sheet material, said handles being secured to said folded top section portion.

8. A covering according to claim 1 wherein said handles are formed of a material identical to said sheet material.

9. A covering according to claim 1 wherein said handles are formed integrally with said sheet material.

10. A covering according to claim 1 including indicia on said sheet material indicative of a plurality of locations of said first foldline along said sheet material in accordance with the height of a book being covered by the covering enabling books having front and back covers of different heights to be covered by said covering, the indicia on said sheet material being indicative of a plurality of locations of said second foldlines along said sheet material in accordance with the width of a book being covered by the covering enabling books of different widths to be covered by said covering.

11. A covering according to claim 1 wherein a section of said top portion is folded about a fourth foldline to overlie a portion of said sheet material, slots formed through said fourth foldline for receiving handles therethrough, said handles being retained between said folded top portion section and the portion of said sheet material underlying said folded top portion section.

12. A covering for a book having front and back covers comprising:

a first sheet of flexible material having top, bottom and opposite side edges and first and second opposite faces;

a second sheet of flexible material overlying a bottom portion of said first sheet material along said first face thereof, said second sheet extending between said opposite side edges of said first sheet and forming with the bottom portion of said first sheet a multi-ply layer along the bottom of the covering;

a panel of said multi-ply layer being folded about a first foldline generally parallel to said bottom edge to overlie a portion of said multi-ply layer, said folded multi-ply panel extending between opposite side edges;

a pair of side panels extending between said top and bottom edges, including end portions of said multi-ply panel folded about respective foldlines generally parallel to said side edges and perpendicular to said bottom edge to overlie portions of said sheet material along said first face thereof and portions of said multi-ply panel;

bottom portions of said folded side panels and the bottom end portions of the multi-ply panel forming pockets for receiving respective corners of the front and back covers of a book;

a pair of handles secured to said sheet material along a top portion thereof and between said side edges, said handles projecting from said top portion for carrying a book overlying said sheet material with bottom corners of the front and back covers of the book received in said pockets, respectively, formed along bottom portions of the covering.

13. A covering according to claim 12 including tabs formed along said top portion of the sheet material adjacent opposite side edges thereof, respectively, and forming part of said side panels, said tabs being folded about respective foldlines generally parallel to said bottom edge to overlie a portion of the sheet material along said first face thereof and being folded with said side panels to overlie portions of said sheet material along said first face thereof, said folded tabs and upper portions of said side panels forming second pockets for receiving other corners, respectively, of the front and back covers of the book.

14. A covering according to claim 12 wherein said handles are adhesively attached to said sheet material.

15. A covering according to claim 12 including indicia on said sheet material indicative of a plurality of locations of said first foldline along said sheet material in accordance with the height of a book being covered by the covering enabling books having front and back covers of different heights to be covered by said covering.

16. A covering according to claim 12 including indicia on said sheet material indicative of a plurality of locations of said side panel foldlines along said sheet material in accordance with the width of a book being covered by the covering enabling books of different widths to be covered by said covering.

17. A covering according to claim 12 wherein said top portion of said sheet material is die cut to form said handles.

18. A covering according to claim 12 wherein a section of said top portion is folded about a foldline to overlie said first face of said sheet material, said handles being secured to said folded top section portion along a second face of said sheet material.

19. A covering according to claim 12 wherein said handles are formed of a material identical to said sheet material.

20. A covering for a book having front and back covers comprising:

a sheet of flexible material having top, bottom and opposite side edges and first and second opposite faces;

a bottom panel of said sheet material being folded about a first foldline generally parallel to said bottom edge to overlie a portion of said sheet material along said first face thereof, said folded bottom panel extending between said opposite side edges;

a pair of side panels extending between said top and bottom edges, and including end portions of said folded bottom panel, folded about second foldlines generally parallel to said side edges and perpendicular to said first foldline to overlie portions of said bottom panel folded about said first foldline;

said folded side panels and the folded bottom end portions of said bottom panel forming pockets for receiving respective front and back covers of a book;

a pair of laterally spaced handles secured to said sheet material between said side edges and along a top portion of the covering opposite said first foldline, said handles projecting from said top portion of the covering for carrying a book overlying said sheet material with bottom corners of the front and back covers of the book received in said pockets, respectively, along a bottom portion of the covering.

* * * * *